US006745647B2

(12) United States Patent
Wang

(10) Patent No.: US 6,745,647 B2
(45) Date of Patent: Jun. 8, 2004

(54) WRENCH HAVING A UNIVERSAL-JOINT RATCHET WHEEL

(76) Inventor: Mei-Chen Wang, P.O. Box 63-247, Taichung (TW)

( * ) Notice: Subject to any disclaimer, the term of this patent is extended or adjusted under 35 U.S.C. 154(b) by 489 days.

(21) Appl. No.: 09/727,397

(22) Filed: Nov. 29, 2000

(65) Prior Publication Data

US 2002/0062718 A1 May 30, 2002

(51) Int. Cl.[7] ..... B25B 13/46
(52) U.S. Cl. ..... 81/60; 81/63.1
(58) Field of Search ..... 81/60–63.2

(56) References Cited

U.S. PATENT DOCUMENTS

| | | | | |
|---|---|---|---|---|
| 15,482 | A | | 8/1856 | Gilman |
| 810,599 | A | | 1/1906 | Ansorge |
| 841,686 | A | | 1/1907 | Hatfield |
| 893,097 | A | | 7/1908 | Reams |
| 915,446 | A | | 3/1909 | Kearnes |
| 1,033,358 | A | | 7/1912 | Turner |
| 1,194,471 | A | | 8/1916 | Boosinger |
| 1,261,092 | A | * | 4/1918 | Allen ..... 81/60 |
| 1,382,492 | A | | 6/1921 | Evans |
| 1,426,127 | A | | 8/1922 | Tuttle |
| 1,614,039 | A | | 1/1927 | Mandl |
| 1,957,462 | A | | 5/1934 | Kress |
| 2,317,461 | A | | 4/1943 | Jackson |
| 2,542,241 | A | | 2/1951 | Fors |
| 2,657,604 | A | | 11/1953 | Rueb |
| 2,701,977 | A | | 2/1955 | Stone |
| 2,764,048 | A | | 9/1956 | Thompson |
| 2,769,360 | A | | 11/1956 | Cottrell et al. |
| 2,800,821 | A | * | 7/1957 | Fruscella ..... 81/60 |
| 2,891,434 | A | | 6/1959 | Lozensky |
| 2,957,377 | A | | 10/1960 | Hare |
| 3,019,682 | A | | 2/1962 | Hare |
| 3,250,157 | A | | 5/1966 | Badger |
| 3,265,171 | A | | 8/1966 | Kilness |
| 3,337,014 | A | | 8/1967 | Sandrick |
| 3,393,587 | A | | 7/1968 | Jolliff et al. |
| 3,393,780 | A | | 7/1968 | Kilness |
| 3,436,992 | A | | 4/1969 | Over et al. |
| 3,577,816 | A | | 5/1971 | Alexander et al. |
| 3,713,356 | A | | 1/1973 | Knudsen |
| 3,742,788 | A | | 7/1973 | Priest |
| 3,838,614 | A | | 10/1974 | O'Donnell |
| 3,908,487 | A | | 9/1975 | Plaw |
| 4,070,932 | A | | 1/1978 | Jeannotte |
| 4,111,077 | A | | 9/1978 | Cummings et al. |
| 4,128,025 | A | | 12/1978 | Main et al. |
| 4,274,311 | A | | 6/1981 | Ebert |
| 4,277,989 | A | | 7/1981 | Tracy |
| 4,277,990 | A | | 7/1981 | Hall |
| 4,308,768 | A | | 1/1982 | Wagner |
| 4,308,769 | A | | 1/1982 | Rantanen |
| 4,328,720 | A | | 5/1982 | Shiel |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—James G. Smith
(74) *Attorney, Agent, or Firm*—Alan D. Kamrath; Nikolai & Mersereau, P.A.

(57) ABSTRACT

A wrench comprises a box end having a compartment and a cavity, a ratchet wheel rotatably mounted in the compartment, and a pawl mounted in the cavity for engaging with the ratchet wheel. An inner periphery defining the compartment of the box end allows universal movement of the ratchet wheel. Retaining edges are formed on an outer periphery of the ratchet wheel for engaging with the pawl to thereby prevent disengagement of the ratchet wheel from the compartment of the box end.

10 Claims, 5 Drawing Sheets

U.S. PATENT DOCUMENTS 4,336,728 A 6/1982 Deibert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A * 5/1987 Kohal ..... 81/60 X
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,499,560 A 3/1996 Aeschliman
5,501,124 A 3/1996 Ashby
5,509,333 A 4/1996 Rion
5,533,427 A * 7/1996 Chow ..... 81/60 X
5,557,994 A 9/1996 Nakayama
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A * 11/2000 Hu ..... 81/60
6,152,826 A 11/2000 Profeta et al.
6,161,454 A 12/2000 Chaconas
6,164,167 A 12/2000 Chen
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,301,998 B1 10/2001 Hu

* cited by examiner

WRENCH HAVING A UNIVERSAL-JOINT RATCHET WHEEL

BACKGROUND OF THE INVENTION

1. Field of the Invention

The present invention relates to a wrench having a universal-joint ratchet wheel, and more particularly to a wrench having a box end in which a universal-joint ratchet wheel is mounted.

2. Description of the Related Art

Wrenches have been widely used and most of them are limited in function especially when the fasteners to be loosened or tightened are located in a difficult-to-access area. The present invention is intended to provide an improved design to solve this problem.

SUMMARY OF THE INVENTION

It is the primary object of the present invention to provide an improved wrench having a box end in which a universal-joint ratchet wheel is mounted. The universal-joint ratchet wheel allows the user to loosen/tighten fasteners that cannot be engaged with the wrench in an upright manner.

A wrench comprising:

a box end comprising a compartment and a cavity;

a ratchet wheel rotatably mounted in the compartment, an inner periphery defining the compartment of the box end allowing universal movement of the ratchet wheel, the ratchet wheel including a plurality of teeth on an outer periphery thereof;

a pawl mounted in the cavity for engaging with the ratchet wheel;

means for biasing the pawl toward the ratchet wheel and thus engaging with the teeth of the ratchet wheel;

the ratchet wheel being completely received in the compartment of the box end when a central axis of the ratchet wheel is coincident with a central axis of the compartment of the box end.

The wrench further comprises means for restraining a tilt angle of the central axis of the ratchet wheel relative to the central axis of the compartment of the box end. The ratchet wheel includes an inner polygonal periphery for engaging with a fastener. The wrench may further comprise means for changing position of the pawl relative to the ratchet wheel, thereby changing the ratcheting direction of the wrench. The outer periphery of the ratchet wheel includes an annular groove for receiving a C-clip to thereby rotatably mount the ratchet wheel in the compartment of the box end. The outer periphery of the ratchet wheel includes an annular ledge formed on an end thereof for engaging with the pawl to prevent disengagement of the ratchet wheel from the compartment of the box end. Alternatively, the outer periphery of the ratchet wheel includes a first annular ledge and a second annular ledge that is axially spaced from the first annular ledge, each of the first annular ledge and the second annular ledge being engagable with the pawl to prevent disengagement of the ratchet wheel from the compartment of the box end.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
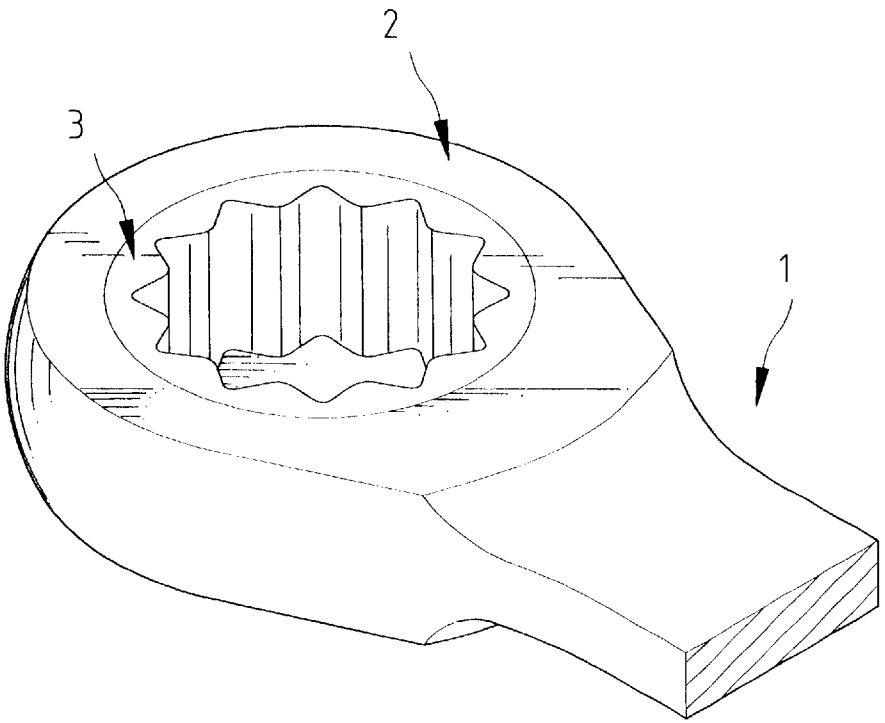
FIG. 1 is a perspective view of an end portion of a wrench in accordance with the present invention.
Figure 2:
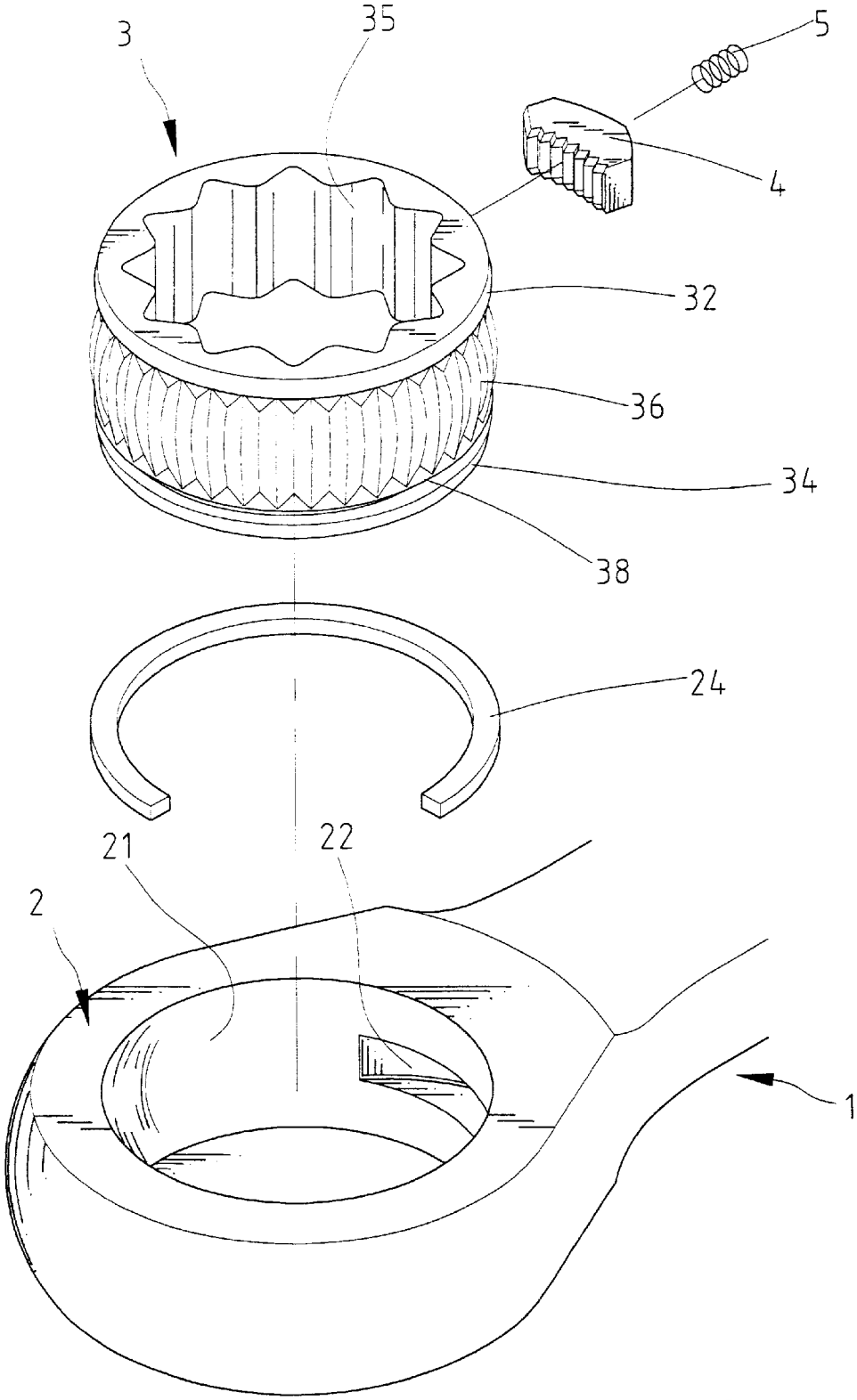
FIG. 2 is an exploded perspective view of the end portion of the wrench in accordance with the present invention.
Figure 3:
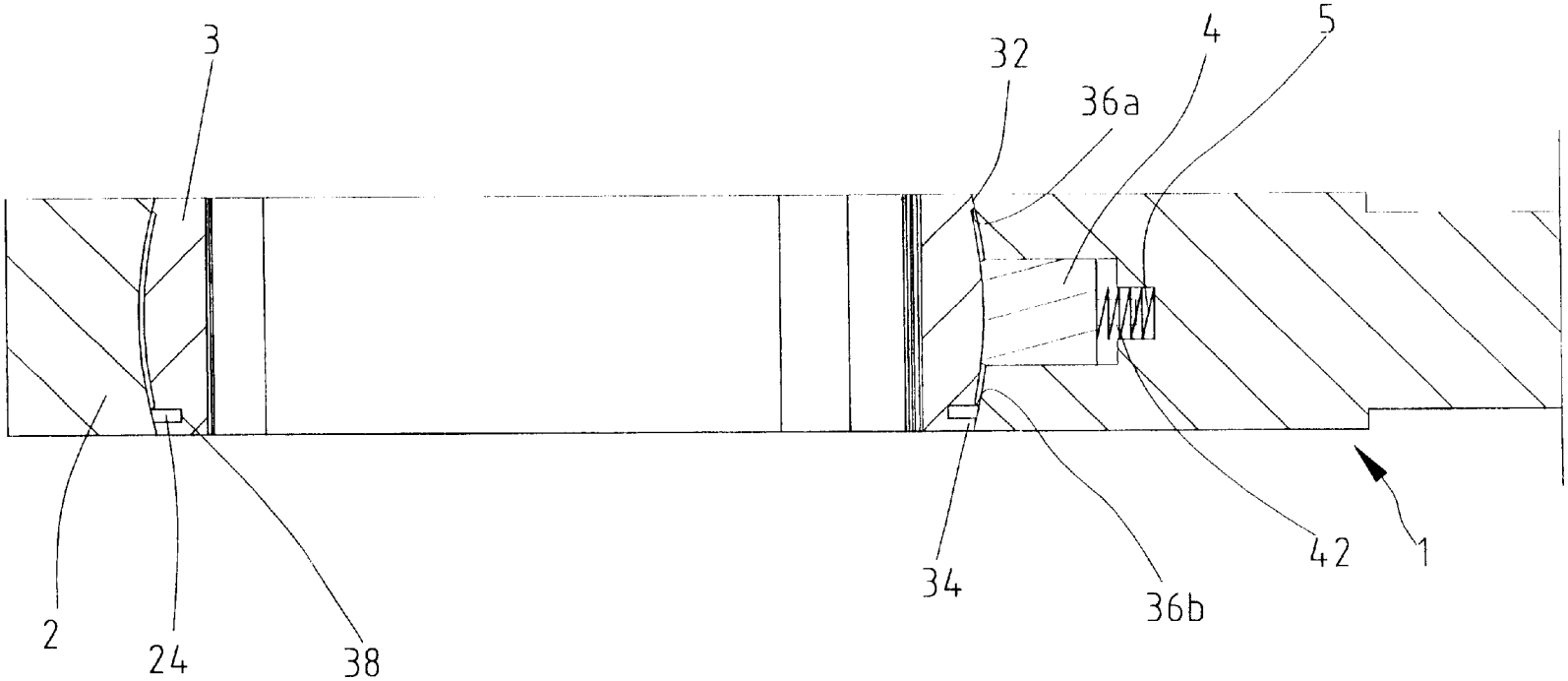
FIG. 3 is a sectional view of the end portion of the wrench in accordance with the present invention.

Referring to FIGS. 1 through 3, a wrench in accordance with the present invention is designated by 1 and generally includes a box end 2 having a comportment 21 and a cavity 22 communicated with the compartment 21. Rotatably mounted in the compartment 21 of the box end 2 is a ratchet wheel 3 that includes an inner polygonal periphery 35 for engaging with a fastener (such as a nut, bolt head. etc.) and a plurality of teeth 36 on an outer periphery thereof. A first annular ledge 32 and a second annular lodge 34 are formed on a first end and a second end of the outer periphery of the ratchet wheel 3, respectively. Namely, the ledges 32 and 34 are axially spaced from each other. In addition, an annular groove 38 is defined in the outer periphery of the ratchet wheel 3 for receiving a C-clip 24 to thereby rotatably mount the ratchet wheel 3 in the compartment 21 of the box end 2.

A pawl 4 is mounted in the cavity 22 of the box end 2 and a portion of an elastic element (e.g. a spring 5) is mounted around a stem 42 of the pawl 4 to bias the pawl 4 toward the ratchet wheel and thus engage with the teeth 36 of the ratchet wheel 3.

As illustrated Lu FIGS. 2 and 3, the annular ledge 32 defines a retaining edge Via for the pawl 4 and the C-clip 24 defines another retaining edge 36*b* for the pawl 4, which will be described later. Alternatively, the retaining edge 36*b* may be formed by the annular ledge 34.

Figure 4:
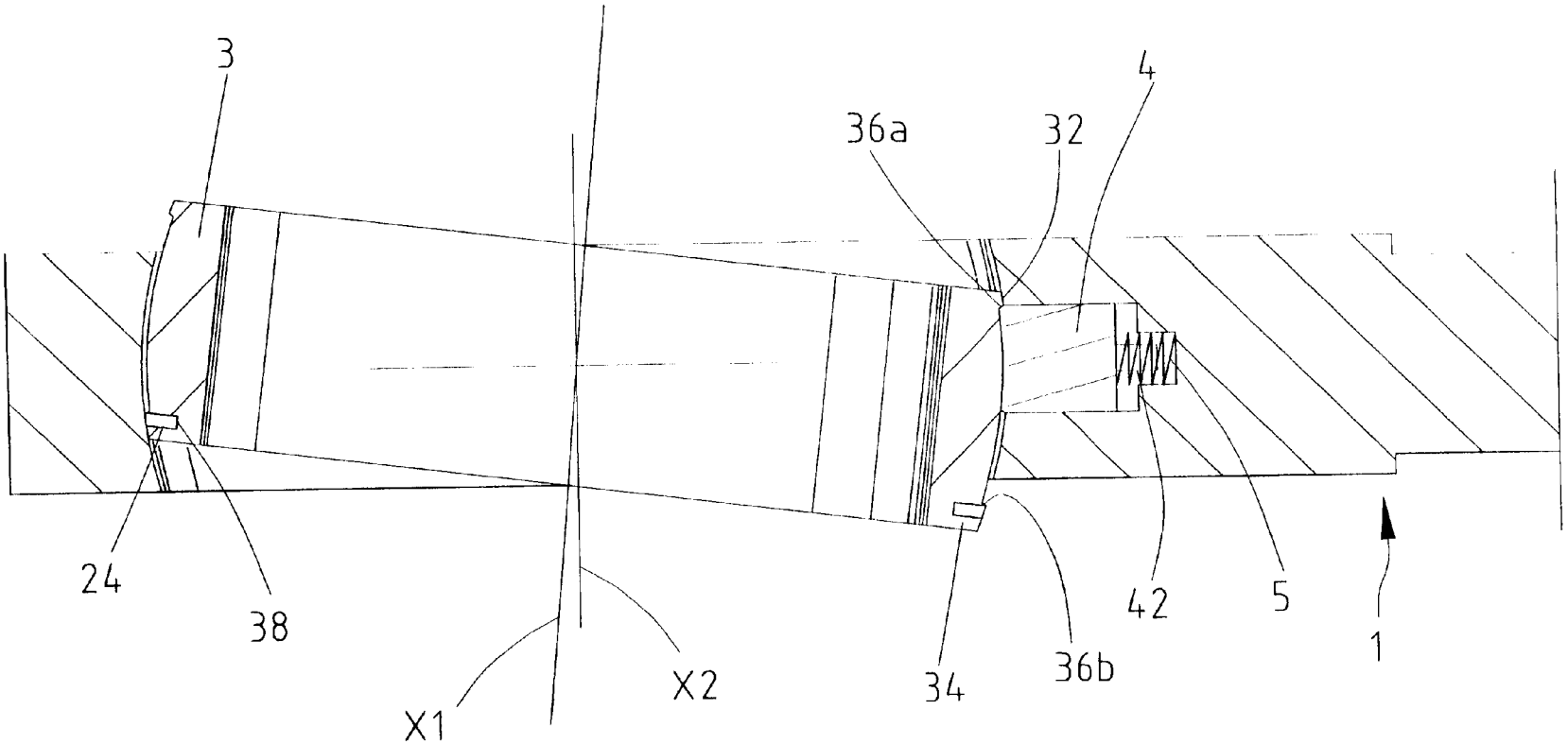
FIG. 4 and FIG. 5 are sectional views similar to FIG. 3, illustrating use of the wrench in accordance with the present invention.
Figure 5:
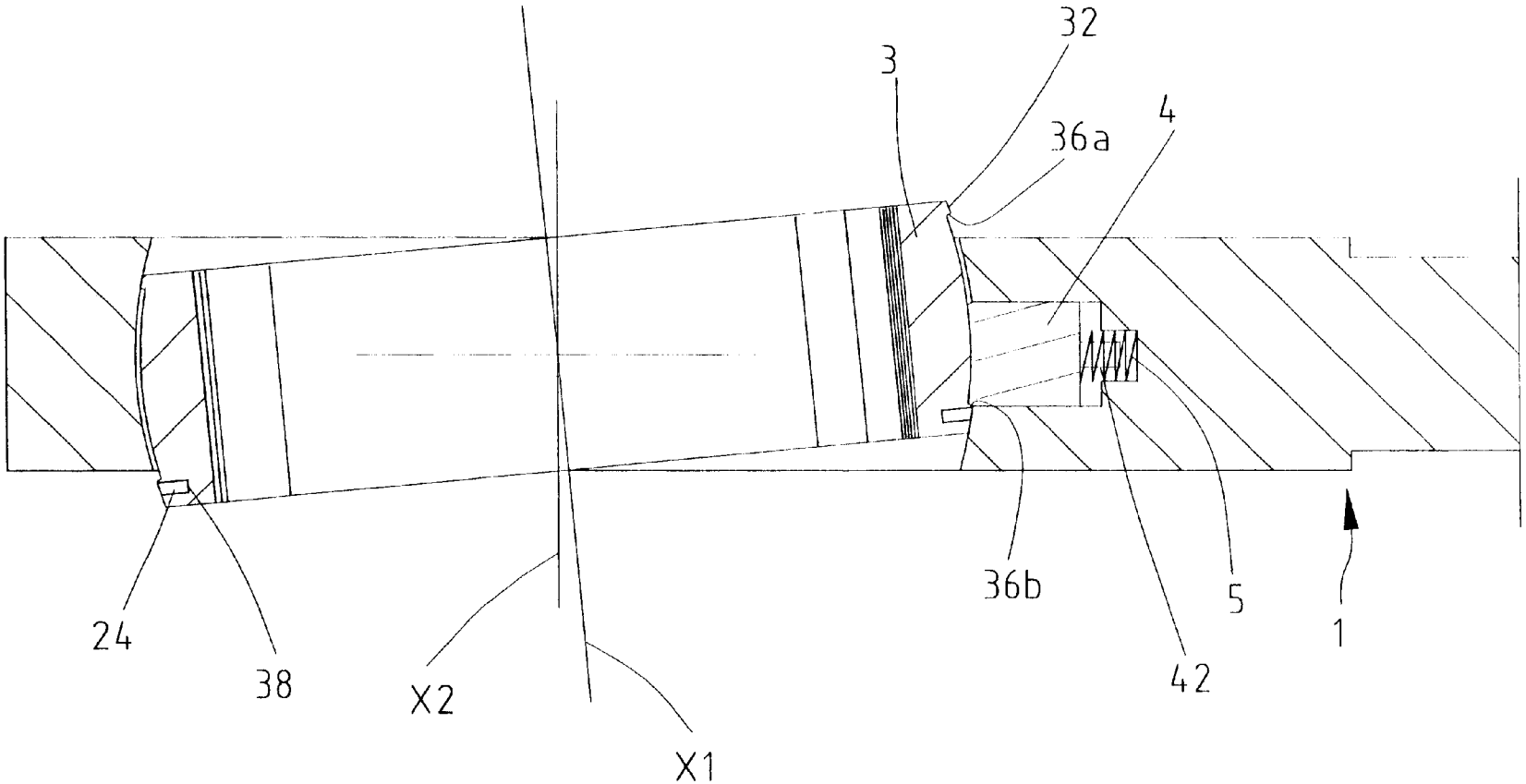

As illustrated in FIGS. 4 and 5, the ratchet wheel 3 is in universal joint with an inner periphery of the box end 2 that defines the compartment 21 so that the ratchet wheel 3 may bc turned to a desired orientation in response to the location of the fastener (not shown) to be loosened or tightened. In addition, disengagement of the ratchet wheel 3 from the box end 2 is prevented by the retaining edges 36*a* and 36*b* that are in contact with the pawl 4 when the ratchet wheel 3 reaches its critical position, best shown in FIGS. 4 and 5. Namely, the retaining edges 36*a* and 36*b* restrain a tilt angle of a central axis X1 of the ratchet wheel 3 relative to a central axis X2 of the compartment 21 of the box end 2. When the ratchet wheel 3 is in an upright status, the central axis X1 of the ratchet wheel 3 coincides with the central axis X2 of the compartment 21, as shown in FIG. 3.

The pawl 4 is biased by the spring 5 to engage with the ratchet wheel 3 to thereby allow ratcheting operation of the wrench in a predetermined direction and free rotation of the ratchet wheel 3 in a reverse direction.

Although the invention has been explained in relation to its preferred embodiment, it is to be understood that many other possible modifications and variations can be made without departing from the scope of the invention as hereinafter claimed.

What is claimed is:

1. A wrench comprising:

a box end comprising a compartment and a cavity;

a ratchet wheel rotatably mounted in the compartment, an inner periphery defining the compartment of the box end allowing universal movement of the ratchet wheel, the ratchet wheel including a plurality of teeth on an outer periphery thereof;

a pawl mounted in the cavity for engaging with the ratchet wheel; and means for biasing the pawl toward the ratchet wheel and thus engaging with the teeth of the ratchet wheel;

the ratchet wheel being completely received in the compartment of the box end when a central axis of the ratchet wheel is coincident with a central axis of the compartment of the box end.

2. The wrench as claimed in claim 1, further comprising means for restraining a tilt angle of the central axis of the ratchet wheel relative to the central axis of the compartment of the box end.

3. The wrench as claimed in claim 1, wherein the ratchet wheel includes an inner polygonal periphery.

4. The wrench as claimed in claim 1, wherein the outer periphery of the ratchet wheel includes an annular groove for receiving a C-clip to thereby rotatably mount the ratchet wheel in the compartment of the box end.

5. The wrench as claimed in claim 1, wherein the outer periphery of the ratchet wheel includes an annular ledge formed on an end thereof for engaging with the pawl to prevent disengagement of the ratchet wheel from the compartment of the box end.

6. The wrench as claimed in claim 1, wherein the outer periphery of the ratchet wheel includes a first annular ledge and a second annular ledge that is axially spaced from the first annular ledge, each of the first annular ledge and the second annular ledge being engagable with the pawl to prevent disengagement of the ratchet wheel from the compartment of the box end.

7. A wrench comprising:

a box end comprising first and second faces and a compartment extending between the first and second faces and defined by an inner periphery;

a ratchet wheel rotatably mounted in the compartment and having an outer periphery, with the inner periphery of the box end and the outer periphery of the ratchet wheel allowing universal movement of the ratchet wheel within the compartment, with the ratchet wheel a plurality of teeth on the outer periphery thereof; and a pawl mounted in the cavity for engaging with the ratchet wheel, with the pawl being biased toward the ratchet wheel and thus engaging with the teeth of the ratchet wheel and having opposite sides, with the outer periphery of the ratchet wheel including a first annular ledge and a second annular ledge that is axially spaced from the first annular ledge less than the spacing between the first and second faces and greater than between the opposite sides of the pawl, with the first annular ledge and the second annular ledge being engagable with the opposite sides of the pawl to prevent disengagement of the ratchet wheel from the compartment of the box end.

8. The wrench as claimed in claim 7, wherein the ratchet wheel includes an inner polygonal periphery.

9. The wrench as claimed in claim 8, wherein the outer periphery of the ratchet wheel includes an annular groove for receiving a C-clip to thereby rotatably mount the ratchet wheel in the compartment of the box end, with the C-clip defining one of the first annular ledge and the second annular ledge.

10. The wrench as claimed in claim 7, wherein the outer periphery of the ratchet wheel includes an annular groove for receiving a C-clip to thereby rotatably mount the ratchet wheel in the compartment of the box end, with the C-clip defining one of the first annular ledge and the second annular ledge.

* * * * *